US010723013B2

(12) United States Patent
Oña González

(10) Patent No.: US 10,723,013 B2
(45) Date of Patent: Jul. 28, 2020

(54) DEVICE FOR ASSEMBLING PANELS

(71) Applicant: Francisco Javier Oña González, Málaga (ES)

(72) Inventor: Francisco Javier Oña González, Málaga (ES)

( * ) Notice: Subject to any disclaimer, the term of this patent is extended or adjusted under 35 U.S.C. 154(b) by 53 days.

(21) Appl. No.: 16/302,390

(22) PCT Filed: May 11, 2017

(86) PCT No.: PCT/ES2017/070300
§ 371 (c)(1),
(2) Date: Nov. 16, 2018

(87) PCT Pub. No.: WO2017/198883
PCT Pub. Date: Nov. 23, 2017

(65) Prior Publication Data

US 2019/0176318 A1 Jun. 13, 2019

(30) Foreign Application Priority Data

May 17, 2016 (ES) ..... 201630625 U

(51) Int. Cl.
*B25B 1/00* (2006.01)
*B25H 1/14* (2006.01)
(Continued)

(52) U.S. Cl.
CPC ..... *B25H 1/14* (2013.01); *B25B 5/10* (2013.01); *B25B 5/142* (2013.01); *B25B 11/02* (2013.01);
(Continued)

(58) Field of Classification Search
CPC .... B25B 5/00; B25B 5/10; B25B 5/02; B25H 1/00; B25H 1/14; B25H 3/00
See application file for complete search history.

(56) References Cited

U.S. PATENT DOCUMENTS 3,643,935 A * 2/1972 Bell ..... B25H 1/00 269/16
4,278,243 A * 7/1981 Alessio ..... B25H 1/04 269/139

(Continued)

FOREIGN PATENT DOCUMENTS

AU 1288483 B2 1/1987
ES 1075154 U 8/2011

OTHER PUBLICATIONS

International Search Repor dated Sep. 12, 2017 re: Application No. PCT/ES2017/070300, pp. 1-3, citing: ES 1 075 154 U, AU 557 657 B2 and US 2009/0183839 A1.

(Continued)

*Primary Examiner* — Lee D Wilson
(74) *Attorney, Agent, or Firm* — Cantor Colburn LLP

(57) ABSTRACT

An apparatus for assembling a panel, the apparatus including a main support, a press head and a movable stop, where the movable stop has at least two adjustable tensioning elements, a stop element and gripping mechanisms, each of the adjustable tensioning elements including a front end and a rear end, each admitting at least one opening position and one closing position, where the stop element is joined in an articulated way to the front ends of the adjustable tensioning elements, where the gripping mechanisms are joined to the rear ends of the adjustable tensioners, the gripping mechanisms admitting a first position in which the adjustable tensioning elements are configured in the opening position and a second position wherein the adjustable tensioning elements are configured in the closing position.

13 Claims, 6 Drawing Sheets

(51) Int. Cl.

| | |
|---|---|
| ***B25H 1/08*** | (2006.01) |
| ***B25B 11/02*** | (2006.01) |
| ***B25B 5/10*** | (2006.01) |
| ***B25B 5/14*** | (2006.01) |
| ***B25H 1/10*** | (2006.01) |
| *B25B 11/00* | (2006.01) |

(52) U.S. Cl.
CPC ..... *B25H 1/08* (2013.01); *B25H 1/10* (2013.01); *B25B 11/00* (2013.01)

(56) References Cited

U.S. PATENT DOCUMENTS

| | | | | | |
|---|---|---|---|---|---|
| 4,294,441 | A * | 10/1981 | O'Banion | B23Q 1/525 | 269/139 |
| 4,527,786 | A * | 7/1985 | Hsu | B25B 1/2426 | 269/154 |
| 5,950,999 | A * | 9/1999 | Lin | B25H 1/14 | 269/139 |
| 2009/0183839 | A1 | 7/2009 | Shackelford | | |
| 2015/0031302 | A1 | 1/2015 | Kawasaki | | |
| 2016/0030330 | A1 | 2/2016 | Morgan et al. | | |
| 2019/0176318 | A1* | 6/2019 | Ona Gonz Lez | B25B 5/10 | |

OTHER PUBLICATIONS

Written Opinion dated Sep. 12, 2017 re: Application No. PCT/ES2017/070300, pp. 1-5, citing: ES 1 075 154 U, AU 557 657 B2 and US 2009/0183839 A1.

* cited by examiner

DEVICE FOR ASSEMBLING PANELS

TECHNICAL FIELD

This disclosure relates to the technical field of apparatuses for assembling glass and profiles through pressing thereof.

BACKGROUND

Thanks to the available technology, it is currently possible to cut glass panes with great precision, obtaining cuts with a tolerance of 1/10,000, that is, 0.1 mm per linear meter.

However, subsequent processes such as polishing the edges are not carried out with this precision, so that, when assembling the glass pane with another element, such as an aluminum profile, there may be measurement variances in said glass panel that prevent it from being a perfect rectangle, thus causing problems in the subsequent assembly of said panels in space enclosure systems.

Utility models U201630330 and U201531302 refer to systems that use these types of glass panels and contain detailed explanations of their operation. The normal process of assembling glass and aluminum profiles on traditional worktables such as those used in window assembly companies produces inaccuracies. Often a subsequent wedging or fitting of the assembled part is needed, together with the consequent measurement in order to ascertain the extent of the wedging or fitting necessary to leave said mounting part within the tolerances.

The present disclosure seeks to avoid such measurement and subsequent wedging or fitting tasks, in addition to reducing the cost and improving the performance of the operation itself, so that said task can be carried out as quickly as possible, thus improving productivity.

BRIEF SUMMARY

In a first inventive aspect, the disclosure defines an apparatus for assembling a panel, the apparatus comprising a main support, a press head and a movable stop. The movable stop comprises:

at least two adjustable tensioning elements, each comprising a front end and a rear end, each of which admits at least one opening position and one closing position;

a stop element, joined in an articulated way to the front ends of the adjustable tensioning elements;

gripping means joined to the rear ends of the adjustable tensioners, the gripping means admitting a first position in which the adjustable tensioning elements are configured in the opening position, and a second position in which the adjustable tensioning elements are configured in the closing position.

The assembly composed of a glass pane to which one or more aluminum profiles are assembled is called a panel in the state of the art. When speaking of a "glass pane", it is understood that any other material suitable for carrying out the function of a door or separating element between rooms, such as wood, PC, PMMA or phenolic resin, is also included. Similarly, when speaking of "profile", in addition to aluminum, it also includes any other material commonly used in this type of applications such as PVC.

This apparatus enables assembling a panel by gluing an aluminum profile to a glass pane, placed in a relatively appropriate position by means of a mechanical press, such that the glass pane and aluminum profile are fastened by means of a known glue. While this assembly process is carried out, thanks to the adjustable tensioning elements, which are suitably calibrated according to the desired size of the joint between the glass pane and the aluminum profile, any possible measurement defects in the glass pane due to the polishing process of its edges or corners are corrected.

This apparatus ensures that the final panel, composed of a glass pane and one or several aluminum profiles, is as rectangular as possible thus correcting possible imperfections in the glass pane after the polishing process of the edges of the glass. It is therefore an apparatus that serves for correcting variances and carrying out the assembly of the panels quickly and uniformly.

In a particular embodiment, the gripping means comprise:

support bars, joined in an articulated way to the rear ends of the adjustable tensioning elements; and articulated means, which enable an intermediate point of each support bar to be fastened to the main support and at the same time allow the articulated movement of said support bar with respect to said intermediate point.

This embodiment enables activating and deactivating the movable stop in a precise manner.

In a particular embodiment, the main support comprises first guiding means and the stop element comprises second guiding means, the first guiding means and the second guiding means being adapted to cooperate in enabling the sliding of the stop element on the main support.

In a particular embodiment, the apparatus further comprises lateral positioning stops joined to the main support.

The existence of lateral positioning stops enables a better positioning of the panel during the assembly operation.

In a particular embodiment, each lateral positioning stop comprises a lateral anchoring element, intended to join the lateral positioning stop to the main support, and a lateral stop element, intended to butt up against the glass pane on one of its sides.

This particular approach enables adjusting the lateral positioning stops in order to suit the different measurements of the panel.

In a particular embodiment, the main support further comprises intermediate supports intended to serve as a support for the glass pane. In a particular embodiment, the intermediate supports comprise an elastomeric end intended to be in contact with the glass pane.

This embodiment enables a more stable support of the panel in the apparatus, since the intermediate supports provided with an elastomeric end allow a better adjustment to the plane of the panel.

In a particular embodiment, the apparatus further comprises support legs, each having an end intended to be in contact with a support surface or the floor, wherein the intermediate supports are arranged on a plane which is inclined towards the side on which the lateral positioning stops are located, enabling a more stable positioning of the panel during assembly.

In a particular embodiment, the main support comprises longitudinal arms and transverse arms, arranged substantially perpendicular to each other.

In a particular embodiment, the main support comprises:

longitudinal adjustment holes arranged according to the longitudinal direction of the main support, suitable for joining the press head to the main support in different positions; and transverse adjustment holes arranged according to the transverse direction of the main support, the transverse direction being substantially perpendicular to the longitudinal direction, suitable for joining the lateral positioning stops to the main support in different positions.

This embodiment enables adjusting the elements that make up the apparatus, such that they can be adjusted to the different panel measurements.

In a particular embodiment, the longitudinal adjustment holes are arranged along the longitudinal arms and the transverse adjustment holes are arranged along the transverse arms.

In a particular embodiment, the apparatus can be dismounted into two parts, such that:

a first part comprises a first portion of the main support, the press head and at least two support legs; and a second part comprises a second portion of the main support, the movable stop and at least two support legs wherein the press head or the movable stop can be extracted and installed in the other part so that said other part comprises the press head and the movable stop.

Advantageously, the presence of two support legs in each part of the main support enables each of the parts to stand separately in a stable manner. This facilitates mounting and allows both parts to be used separately. In order to achieve the latter, it is envisaged that either the press head or the movable stop can be extracted and installed in the other part. This way, one of the two parts would contain the movable stop and the press head, thus becoming operative for mounting smaller panels in which the whole table would be less suitable.

In a particular embodiment, the lateral positioning stops comprise length adjustment means, suitable for varying the length of the lateral positioning stop.

BRIEF DESCRIPTION OF THE DRAWINGS

As a complement of the description provided herein and for the purpose of better understanding the disclosure, said description is accompanied by a set of drawings. Said drawings are an integral part of the description and illustrate one or more particular examples, which should not be construed as restricting the scope of protection of the disclosure, but rather as an example of how the disclosure can be carried out. The set of drawings comprises the following figures.

DETAILED DESCRIPTION

Figure 1:
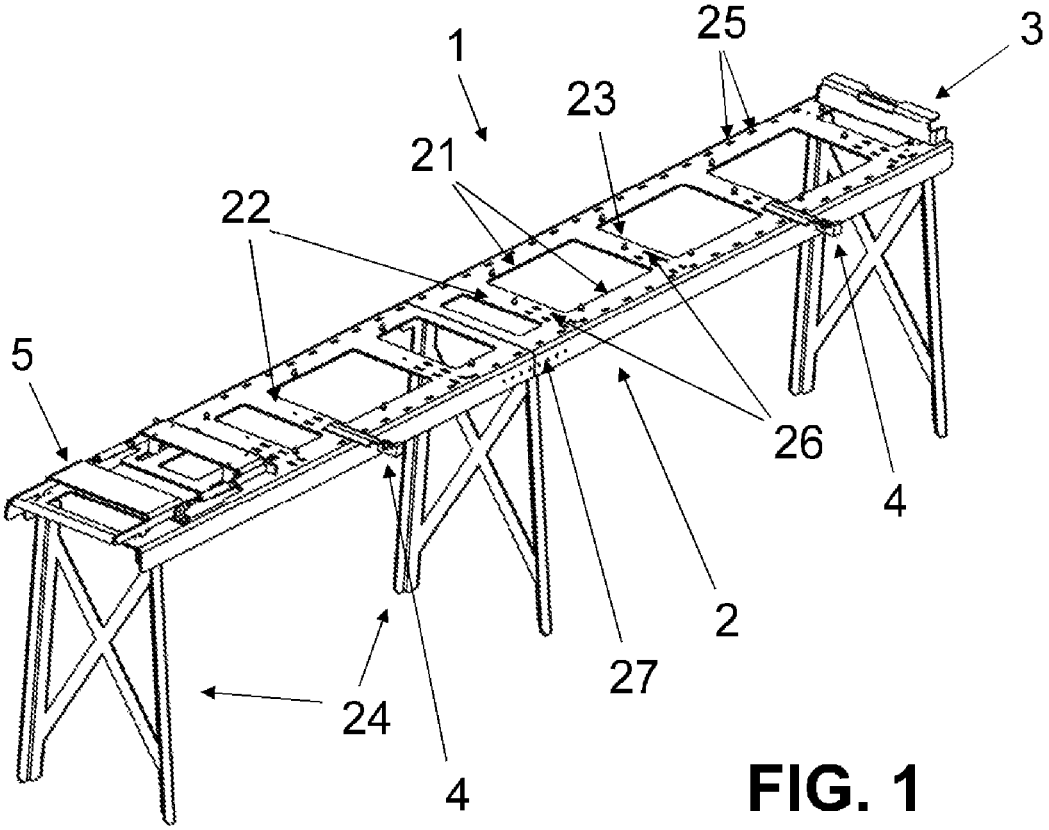
FIG. 1 shows a perspective view of an apparatus for assembling panels according to the disclosure.

FIG. 1 shows an apparatus (1) for assembling a panel according to the disclosure, in which the following elements can be observed:

a main support (2);

a press head (3) arranged on the main support (2);

a plurality of intermediate supports (23) that serve to support the glass pane, said intermediate supports (23) being arranged on the main support (2);

a plurality of lateral positioning stops (4) of the glass on the table; and a movable stop (5) arranged on the main support (2).

The main support (2) in this Figure has a structure with longitudinal arms (21) and transverse arms (22). The longitudinal arms (21) are substantially perpendicular to the transverse arms (22). Nevertheless, in different embodiments this support may be a board or any other surface on which the different elements that make up the apparatus (1) can be arranged.

In the embodiment shown in this Figure, the main support (2) further comprises the following elements:

support legs (24) for maintaining the main support (2) at a certain height so that the workers can work comfortably;

longitudinal adjustment holes (25) comprised in the longitudinal arms (21) that enable joining the press head (3) to the main support (2) in different positions along the longitudinal arm (21);

transverse adjustment holes (26) comprised in the transverse arms (22) that enable joining the lateral positioning stops (4) to the main support (2) in different positions along the transverse arm (22); and mounting means (27) enabling the main support (2) to be dismounted into several pieces, thus facilitating its mounting, dismounting and packaging.

In this embodiment, the longitudinal adjustment holes (25) are located along the longitudinal arms (21) such that two consecutive elements are always separated by the same distance. In addition, said holes are symmetrically positioned with respect to the median plane between both longitudinal arms.

In this embodiment, the mounting means (27) comprise four M8-type screws for each side of the main support (2), as well as four din-1481 type resilient pins having a diameter of 8, for each side, in order to ensure accurate assembly.

Figure 2:
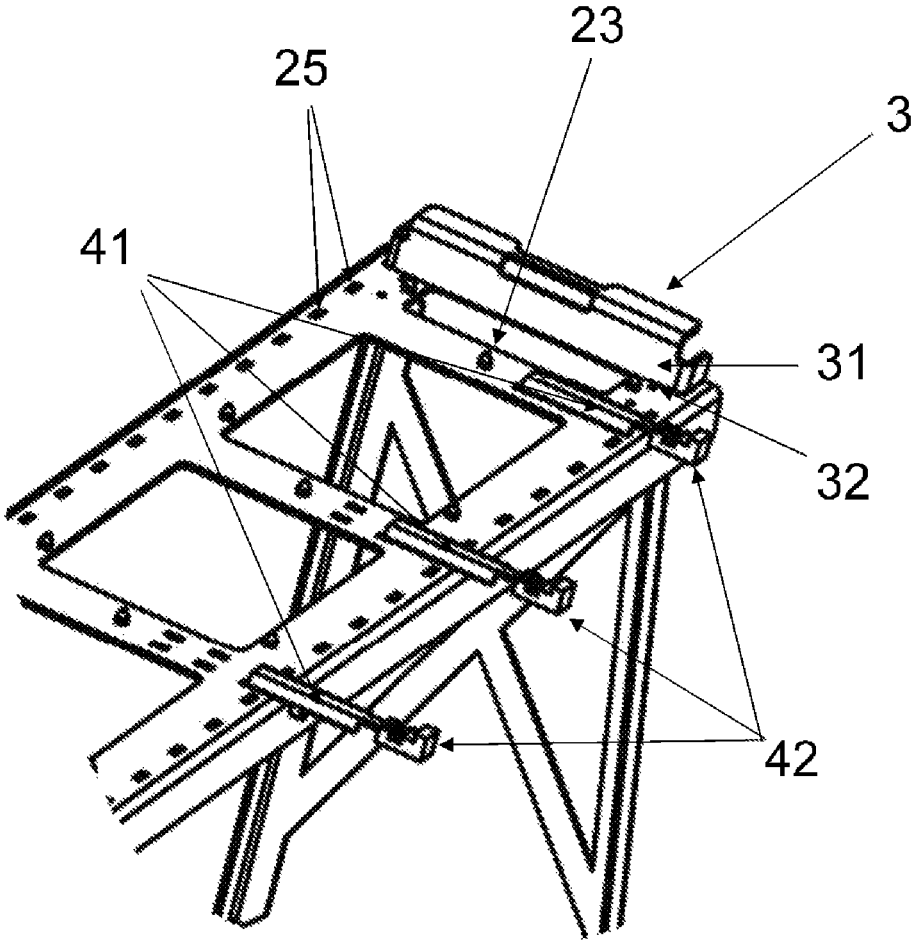
FIG. 2 shows a detail of some elements of the apparatus shown in FIG. 1.

FIG. 2 shows a detail of some of the elements of the apparatus (1) of the previous Figure.

In the embodiment shown in this Figure, the press head (3) comprises a plate (31) and stop anchoring means (32) for adjusting the plate (31) on the main support (2). In this Figure, the stop anchoring means (32) are teeth that secure the plate (31) to the main support (2) by means of the longitudinal adjustment holes (25) comprised in said main support (2).

The press head (3) is intended to serve as a stop for the panel to be assembled, resting on the main support (2), such that when the panel butts up on the main support (2) and the movable stop is passed from an opening position to a closing position, the panel moves against the press head (3) such that the panel is delimited by the press head (3) on one side and by the movable stop on the other side.

The movable stop and the press head (3) make contact with only two parallel sides of the panel. The assembly process causes the adhesive element to join at least one profile to the glass pane on the two sides on which the panel makes contact with the movable stop (5) and the press head (3), such that once the assembly operation is completed, the distance between the edges of the panel intended to contact with the movable stop (5) and the press head (3) is the same as the distance between the movable stop (5) and the press head (3), the latter distance having been previously calibrated.

The intermediate supports (23) are elements comprising an elastomeric end intended to be in direct contact with the glass pane, supporting its weight without damaging it when placing it on the support, and hindering its movement on the plane of the pane. Elastomeric material is understood as any material whose glass transition temperature is below room temperature (25° C.). Glass transition temperature is considered to be the measurement obtained through differential scanning calorimetry with modulated temperature.

Each lateral positioning stop comprises:

a lateral anchoring element (41), which joins the lateral positioning stop to the main support (2) by means of transverse adjustment holes (26); and a lateral stop element (42) intended to butt up against the panel on one of its sides, that is, on one of the sides substantially perpendicular to the side of the panel that butts up against the press head (3), preventing the displacement of the glass pane in the direction towards the lateral stop during the assembly operation.

The plane forming the main support (2) is slightly inclined with respect to the floor plane, specifically, it is lower on the side where the lateral positioning stops (4) are located. This inclination helps the panel to contact against the lateral positioning stops (4) making the assembly operation simpler and faster.

Figure 3:
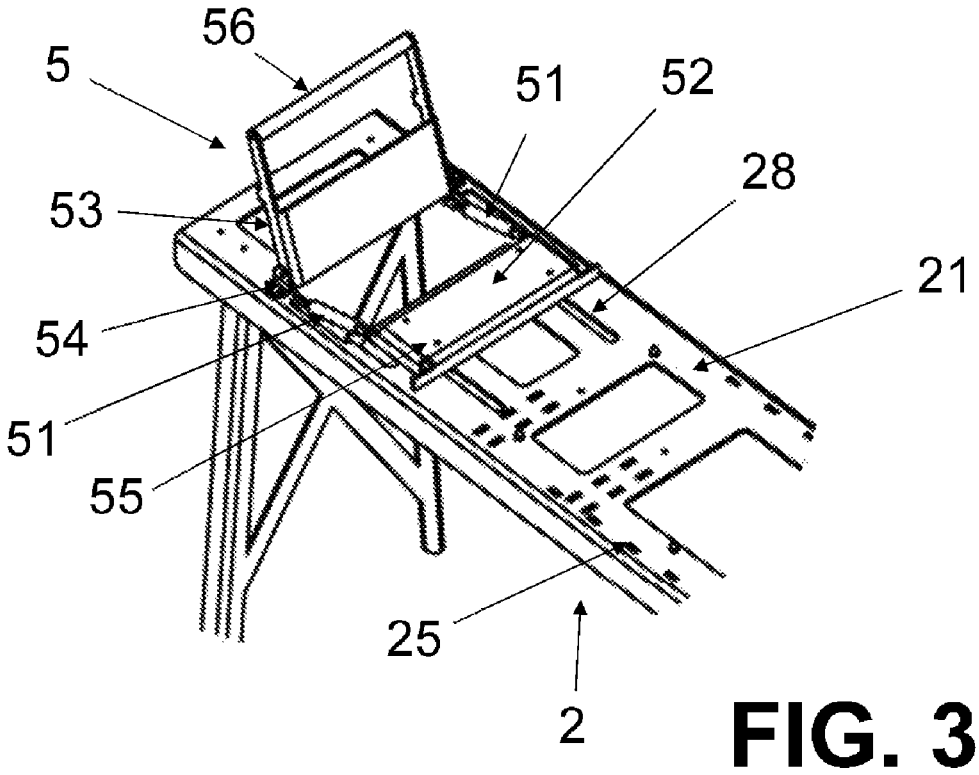
FIG. 3 shows a detail of the movable stop of the apparatus shown in FIG. 1, in the open position.
Figure 4:
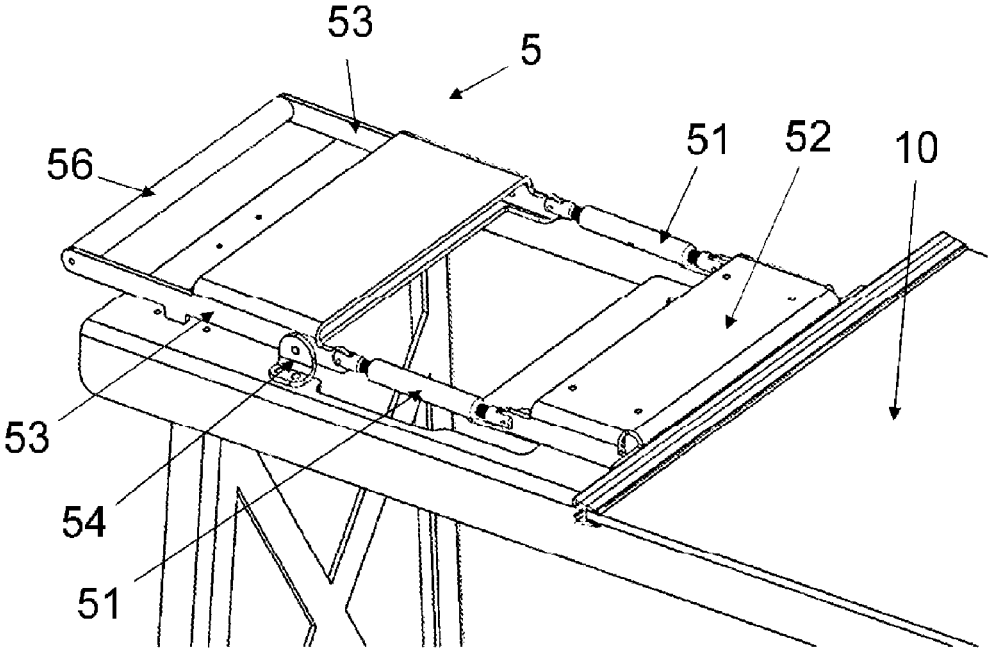
FIG. 4 shows a detail of the movable stop of the apparatus shown in FIG. 1, in the closed position.

FIGS. 3 and 4 illustrate a detail of the area of the apparatus comprising the movable stop in a particular embodiment of the apparatus. As can be seen in both figures, in this particular embodiment the movable stop (5) comprises:

at least two adjustable tensioning elements (51), each comprising a front end and a rear end;

a stop element (52) joined in an articulated way to the front ends of the adjustable tensioners (51);

support bars (53) joined in an articulated way to the rear ends of the adjustable tensioners (51); and articulated joining means (54), which enable an intermediate point of each support bar (53) to be fastened to one of the longitudinal adjustment holes (25) of the main support (2) and at the same time allow the articulated movement of said support bar (53) with respect to said intermediate point.

In this embodiment, the main support (2) comprises two longitudinal guiding grooves (28) and the stop element (52) comprises guiding elements (55) that can be slid through the longitudinal guiding grooves (28) such that the stop element (52) can be slid on the main support (2) in a direction parallel to the longitudinal arms (21). In alternative embodiments, the longitudinal guiding grooves are comprised in the stop element (52) and the guiding elements that can be slid are located on the main support (2), so that the same cooperation is carried out between the longitudinal guiding grooves and the guiding elements if the first are located in the main support and the second are located in the stop elements or vice versa. Therefore, it can be said in general terms that the main support (2) comprises first guiding means and the stop element (52) comprises second guiding means, so that the first guiding means and the second guiding means are adapted to cooperate in enabling the sliding of the stop element on the main support (2).

The adjustable tensioning elements (51) move simultaneously to displace the stop element (52) maintaining it always in the same direction parallel to the press head (3).

The movable stop (5) is intended to serve as a stop on the opposite side, substantially parallel to the side of the panel intended to butt up against the press head (3). The movable stop (5) is displaced from its opening position to its closing position by moving the lever (56) from a first position to a second position, because the lever is attached to a support bar (53) which in turn is joined in an articulated way to the main support (2) by means of articulated joining means (54).

The movable stop is adjusted with the adjustable tensioning elements (51). In a particular embodiment, the adjustment range of the adjustable tensioning elements (51) is at least the distance between two longitudinal adjustment holes (25) such that if further adjusting is required, the press head (3) is moved to the next longitudinal adjustment hole (25). In a particular embodiment, the adjustment range of the adjustable tensioning elements (51) is at least between 0 and 120 mm.

Since the movable stop (5) maintains the same position as long as the adjustment of the adjustable tensioning elements (51) does not take place, several panels can be assembled with the movable stop (5) remaining in the same position. This is advantageous since it is usually necessary to glue more than one panel.

FIG. 3 shows the movable stop (5) in open position. In this position, the glass pane is released so it can be removed and a new pane can be placed for pressing.

FIG. 4 shows the movable stop (5) in closed position. In this position, the panel (10) is retained by the movable stop (5) on the side shown in the Figure and by the press head on the opposite side, which is not shown in the Figure.

The operation of the assembly device begins by positioning the movable stop (3) in the open position, as shown in FIG. 3. To this end, the support bars (53) are far enough away from their parallel position to the main support (2) so that the adjustable tensioning elements (51) have no tension. The distance between the stop element (52) and the press head must be sufficient so that the glass pane to be pressed is placed between these two elements.

The lateral positioning stops (4) are then conveniently placed at a convenient distance so that the panel (10) can butt up against them and is centered with respect to the main support (2).

Once these elements are conveniently located, the panel (10) is positioned, butting up against the press head on one of its sides and against the lateral positioning stops on a side substantially perpendicular to the side butting up against the press head. Usually, the sides of the panel (10) butting up against the press head and against the movable stop (5) will be shorter than the sides of the panel (10) butting up against the lateral positioning stops, although in other particular embodiments, they may be longer.

Once the panel (10) is positioned, the movable stop (5) is moved to the closing position shown in FIG. 4 by means of the rotation of the support bars (53), which involves the displacement of the adjustable tensioning elements (51) and therefore, the displacement of the stop element, since the support bars (53), the adjustable tensioning elements (51) and the stop element (52) are joined sequentially. The stop element (52) is displaced in the longitudinal direction of the main support (2), which is the direction towards the press head (3), driving one of the profiles to be pressed against the glass pane. These adjustable tensioning elements (51) are calibrated to the desired length between the opposite end, in contact with the press head and the profile to be assembled, in contact with the movable stop (5) during this assembly operation. Therefore, since the distance between both elements is calibrated, the glue will absorb the dimensional tolerances resulting from an inaccurate cut of the glass pane.

Figure 5A:
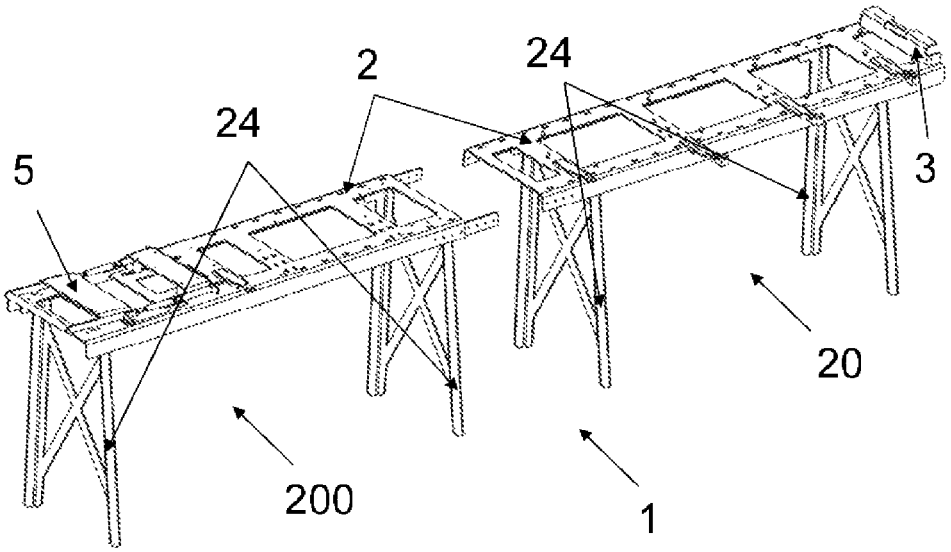
FIGS. 5*a* and 5*b* show two views of another embodiment of an apparatus for assembling panels according to the disclosure.
Figure 5B:
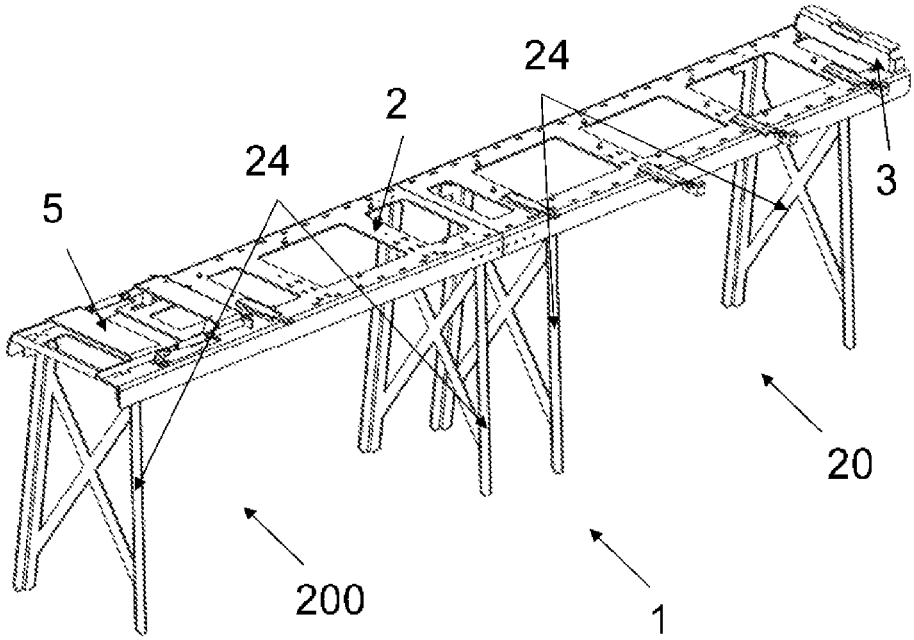

FIGS. 5*a* and 5*b* show a different embodiment of an apparatus (1) for assembling a panel, according to the disclosure. In this case, the apparatus (1) is divided into two parts, a first part (20) comprises a first portion of the main support (2), the press head (3) and at least two support legs (24); and a second part (200) comprises a second portion of the main support (2), the movable stop (5) and two support legs (24).

In this embodiment, the two parts of the apparatus (1) for assembling a panel are able to stand independently, both having two support legs. Support legs, as seen throughout the document, are understood as structures that have two support points on the floor, such that, with two support legs, each part has four support points on the floor.

The mounting of both parts is also simpler in this embodiment of the apparatus (1) because each part can remain stable on the floor before the assembly takes place.

In addition, when the panel is small enough, there is no need to use the entire apparatus (1), and one of the parts can be used to carry out small assemblies, provided that said part comprises a press head (3) and a movable stop (5). These elements can be dismounted and remounted on each of the parts of the table if necessary in order to achieve this result.

Figure 6:
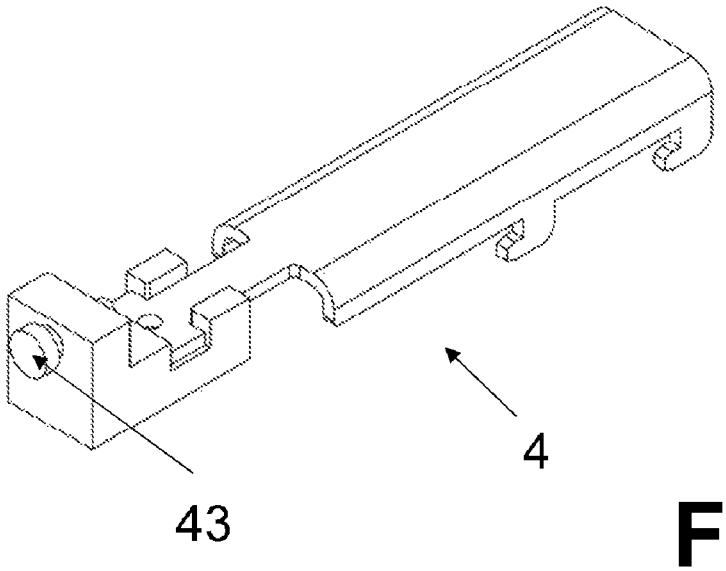
FIG. 6 shows a detail of a lateral positioning stop of an apparatus for assembling panels according to the disclosure.

FIG. 6 shows a detail of a lateral positioning stop (4) included in an embodiment of an apparatus (1) for the mounting of glasses according to an embodiment of the disclosure.

The lateral positioning stop (4) has length adjustment means (43). Specifically, in this embodiment it is a screw which, when screwed or unscrewed, varies the length of the lateral positioning stop (4) thus enabling it to adapt to different sized panels.

Throughout the present specification, the term "comprise" and its derivatives "comprising", etc., should be understood in a non-exclusive manner, that is, without excluding the possibility that what is defined may include additional elements or steps.

The disclosure is not limited to the particular examples described herein, but also includes any variant that may be considered by a person skilled in the art (such as a choice of materials, dimensions, configuration) falling within the scope of protection of the disclosure as defined in the claims.

The invention claimed is:

1. An apparatus for assembling a panel, the apparatus comprising a main support, a press head and a movable stop, wherein the movable stop comprises at least two adjustable tensioning elements each comprising a front end and a rear end, each admitting at least one opening and one closing position;

a stop element, joined in an articulated way to the front ends of the adjustable tensioning elements;

gripping means joined to the rear ends of the adjustable tensioners, the gripping means admitting a first position in which the adjustable tensioning elements are configured in the opening position and a second position wherein the adjustable tensioning elements are configured in the closing position.

2. The apparatus according to claim 1, wherein the gripping means comprise support bars, joined in an articulated way to the rear ends of the adjustable tensioning elements; and articulated means, which enable an intermediate point of each support bar to be fastened to the main support and at the same time allow the articulated movement of said support bar with respect to said intermediate point.

3. The apparatus according to claim 1, wherein the main support comprises first guiding means and the stop element comprises second guiding means, the first guiding means and the second guiding means being adapted to cooperate in enabling the sliding of the stop element on the main support.

4. The apparatus according to claim 1, further comprising lateral positioning stops joined to the main support.

5. The apparatus according to claim 4, wherein each lateral positioning stop comprises a lateral anchoring element, intended to join the lateral positioning stop to the main support, and a lateral stop element, intended to butt up against the glass pane on one of its sides.

6. The apparatus according to claim 1, wherein the main support further comprises intermediate supports intended to serve as a support for the glass pane.

7. The apparatus according to claim 6, further comprising support legs, each having an end intended to be in contact with a support surface or floor, wherein the intermediate supports are arranged on a plane which is inclined towards the side on which the lateral positioning stops are located.

8. The apparatus according to claim 6, wherein the intermediate supports comprise an elastomeric end intended to be in contact with the glass pane.

9. The apparatus according to claim 1, wherein the main support comprises longitudinal arms and transverse arms, arranged substantially perpendicular to each other.

10. The apparatus according to claim 1, wherein the main support comprises longitudinal adjustment holes arranged according to the longitudinal direction of the main support, suitable for joining the press head to the main support in different positions; and transverse adjustment holes arranged according to the transverse direction of the main support, the transverse direction being substantially perpendicular to the longitudinal direction, suitable for joining the lateral positioning stops to the main support in different positions.

11. The apparatus according to claim 10, wherein the longitudinal adjustment holes are arranged along the longitudinal arms and the transverse adjustment holes are arranged along the transverse arms.

12. The apparatus according to claim 1, being able to be dismounted into two parts, such that a first part comprises a first portion of the main support, the press head and at least two support legs; and a second part comprises a second portion of the main support, the movable stop and at least two support legs;

wherein the press head or the movable stop can be extracted and installed in the other part so that said other part comprises the press head and the movable stop.

13. The apparatus according to claim 4, wherein the lateral positioning stops comprise length adjustment means, suitable for varying the length of the lateral positioning stop.

* * * * *